US005813522A

United States Patent [19]

Lin

[11] Patent Number: 5,813,522

[45] Date of Patent: Sep. 29, 1998

[54] SLIDING SWITCH

[76] Inventor: Chao-Chi Lin, No. 2, Jin-Chein 4th Street, Taichung, Taiwan

[21] Appl. No.: 898,914

[22] Filed: Jul. 23, 1997

[51] Int. Cl.[6] ..... H01H 15/06

[52] U.S. Cl. ..... 200/550; 200/548; 200/549

[58] Field of Search ..... 200/550, 549, 200/548, 547, 551, 539, 537

[56] References Cited

U.S. PATENT DOCUMENTS

| | | | |
|---|---|---|---|
| 1,799,920 | 4/1931 | Meuer | 200/550 |
| 3,872,269 | 3/1975 | Schneider | 200/547 |
| 5,051,549 | 9/1991 | Takano | 200/549 |

*Primary Examiner*—David J. Walczak
*Attorney, Agent, or Firm*—Charles E. Baxley, Esq.

[57] ABSTRACT

A sliding switch includes a housing, a sliding seat slidably received in the housing, a fixing member securely mounted in the sliding seat to move therewith, and a wheel rotatably mounted to the fixing member. A face plate is securely mounted in the housing and located above the sliding seat. The face plate includes a number of pairs of slots, and a number of pairs of prongs respectively extend through the slots. The face plate further includes at least two V-shape operative grooves defined in the underside thereof. The wheel is movable from one of the operative groove to other operative groove to provide selective electrical connection between the prongs. Each operative groove includes two inclined surfaces which meet at a common upper end thereof. The wheel contacts with the two inclined surfaces of the associated operative groove to provide reliable electrical connection.

4 Claims, 6 Drawing Sheets

SLIDING SWITCH

BACKGROUND OF THE INVENTION

1. Field of the Invention

The present invention relates to an improved sliding switch with reliable contacts.

2. Description of the Related Art

FIG. 7 of the drawings illustrates a typical sliding switch which includes a housing 50 having a sliding seat 51 slidably received therein. The sliding seat 51 includes a receiving compartment 52 for receiving a steel ball 54 and a spring 53 therein. The steel ball 54 is biased upwardly by the spring 53 to allow smooth sliding of the sliding seat 51 in the housing 50, which, in turn, allows the sliding seat 51 to be switched between two positions to provide selective electrical connection between three pairs of prongs 56. Such a sliding switch is used on computers and is relatively small such that the user often uses his/her finger nail to operate. Nevertheless, the user has to apply a relatively large force to move the switch as the spring 53 has to overcome static frictional resistance of the steel ball 54. In some occasions, the sliding switch may have poor electrical connection. In addition, the spring 53 cannot provide a stable support to the steel ball 54 such that when the steel ball 54 slides along an underside of a face plate 55 through which the prongs 56 extend, the face plate 55 is subjected to an uneven force and thus tends to sway which might adversely affect the electrical connection. Furthermore, the steel ball 54 contacts with the face plate 55 only at a point which may result in poor electrical connection after a term of usage.

The present invention is intended to provide an improved sliding switch which mitigates and/or obviates the above problems.

SUMMARY OF THE INVENTION

A sliding switch in accordance with the present invention includes a housing having a compartment defined therein. A sliding seat is slidably received in the compartment of the housing and includes a bottom plate. The bottom plate has an operative means mounted to an underside thereof proceeding with sliding motion of the sliding seat in the housing. A fixing means is securely mounted in the sliding seat to move therewith, and a wheel is rotatably mounted to the fixing means.

A face plate is securely mounted in the housing and located above the sliding seat. The face plate includes a plurality of pairs of slots, and a plurality of pairs of prongs respectively extend through the slots. The face plate further includes at least two V-shape operative grooves defined in the underside thereof. The wheel is movable from one of the operative groove to other operative groove to provide selective electrical connection between the prongs. Each operative groove includes two inclined surfaces which meet at a common upper end thereof. Means are provided for biasing the fixing plate toward the face plate such that the wheel contacts with the two inclined surfaces of the associated operative groove.

In a preferred embodiment of the invention, the bottom plate of the sliding seat includes two spaced first recesses defined in an upper side thereof, and the fixing means includes two spaced second recesses defined in an underside thereof and respectively in alignment with the first recesses. The biasing means includes two springs respectively, received in the aligned associated said first recess and the associated second recess.

The sliding seat may include two side walls each of which have a notch defined in an inner side thereof, and the fixing means may include two ends respectively securely received in said notches. The housing may include a second bottom plate which has an opening defined therein, and the operative means on the sliding seat extends through the opening of the housing for manual operation.

Other objects, advantages, and novel features of the invention will become more apparent from the following detailed description when taken in conjunction with the accompanying drawings.

DESCRIPTION OF THE PREFERRED EMBODIMENT

Figure 1:
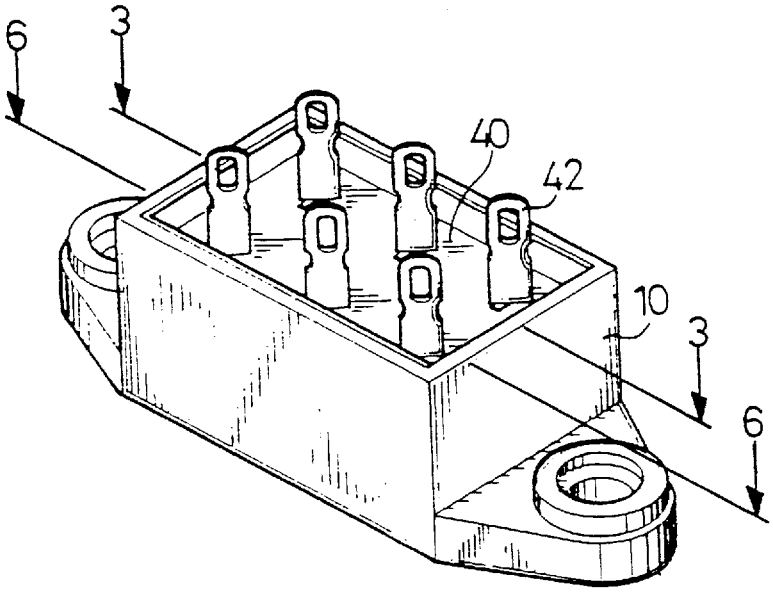
FIG. 1 is a perspective view of a sliding switch in accordance with the present invention.
Figure 2:
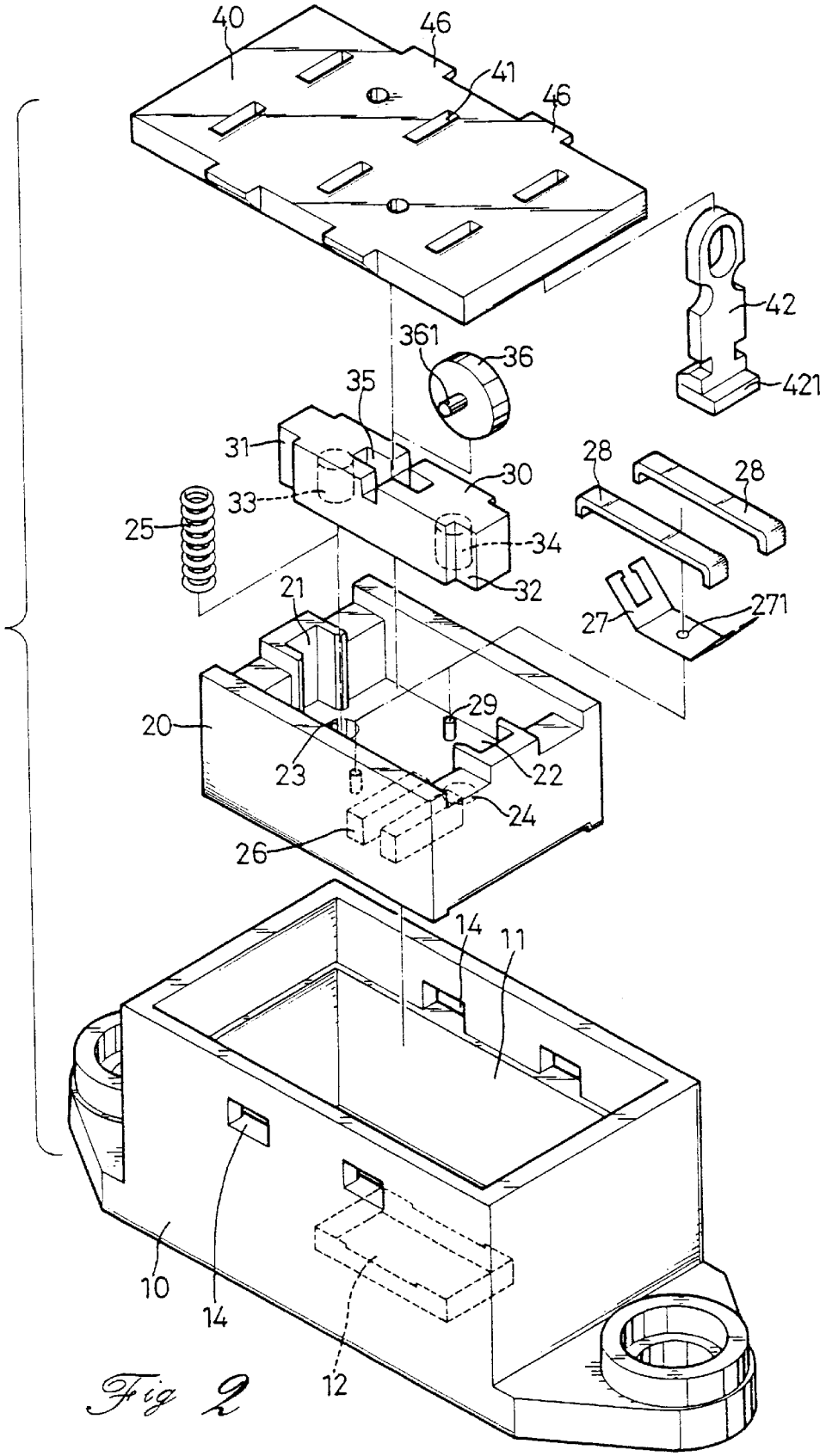
FIG. 2 is an exploded perspective view of the sliding switch in accordance with the present invention.
Figure 7:
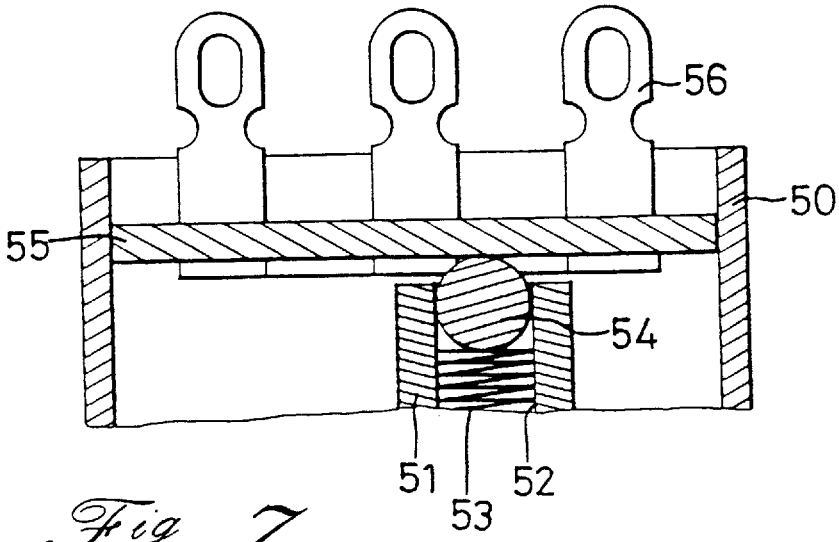
Fig 7 PRIOR ART
FIG. 7 is a sectional view of a prior art sliding switch.
Figure 3:
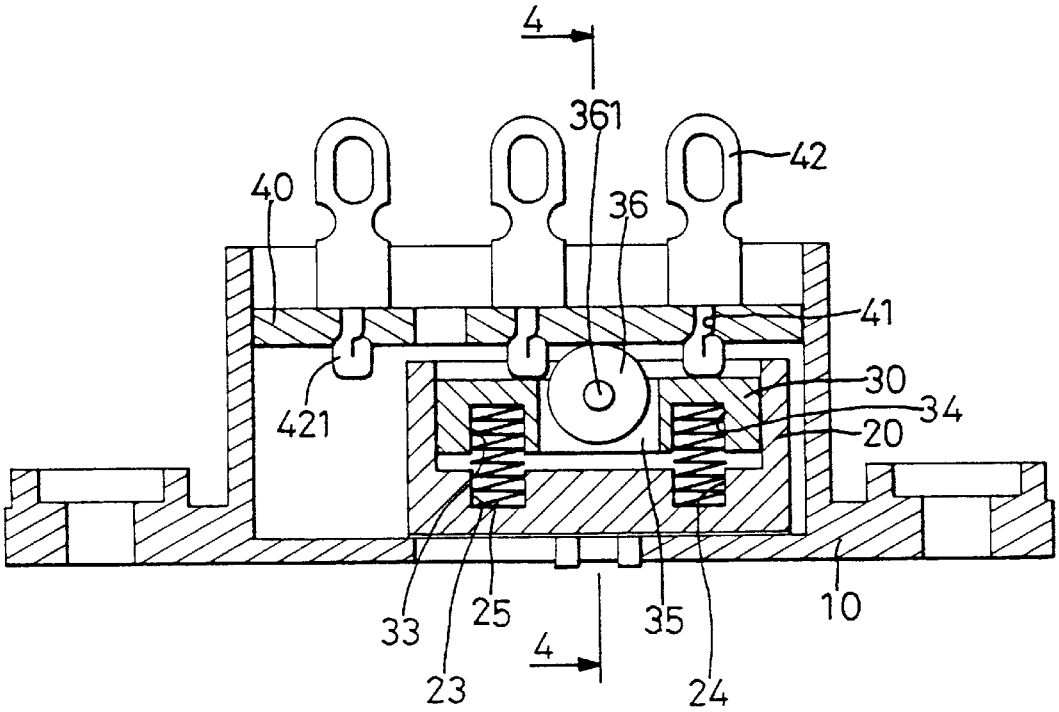
FIG. 3 is a cross sectional view taken along line 3—3 in FIG. 1.

Referring to FIGS. 1 to 3 and particularly to FIG. 2, a sliding switch in accordance with the present invention generally comprises a substantially rectangular housing 10 having a compartment 11 defined therein. An opening 12 is defined in a bottom plate (not labeled) of the housing 10. A substantially rectangular sliding seat 20 is slidably received in the compartment 11 of the housing 10 and includes an open upper side. Formed on an underside of a bottom plate (not labeled) of the sliding seat 20 is an operative means, e.g., two blocks 26 which extend through the opening 12 for manual operation. Two spaced first recesses 23 and 24 (FIG. 3) are defined in an upper side of the bottom plate of the sliding seat 20. The sliding seat 20 further includes two side walls each of which have a notch 21, 22 defined in an inner side thereof. In addition, as shown in FIG. 2, a pair of studs 29 are provided on the upper side of the bottom plate of the sliding seat 20, and a pair of elastic U-shaped plates 27 are respectively mounted to the studs 29. Each plate 27 has a hole 271 defined in a mediate section thereof through which the associated stud 29 extends. A conductive plate 28 is mounted on top of each elastic plate 27 and is thus biased upward to selectively interconnect three pairs of prongs 42, which will be described later.

A fixing means 30 includes two ends 31 and 32 respectively, securely received in the notches 21 and 22 and thus retained in position. The fixing means 30 further includes two spaced second recesses 33 and 34 (FIG. 3) defined in an underside thereof and respectively in alignment with the first recesses 23 and 24. A spring 25 is received in each pair of the aligned first and second recesses 23 and 33; 24 and 34. In addition, the fixing means 30 includes a cruciform groove 35 defined in an upper side thereof for rotatably receiving a wheel 36 with an axle 361.

Figure 2A:
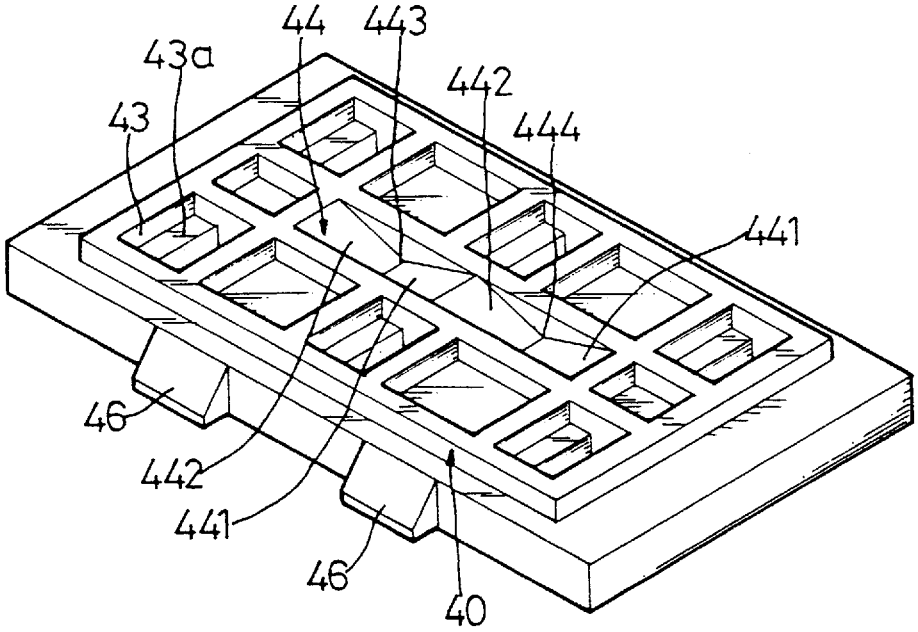
FIG. 2A is a perspective illustrating an underside of a face plate of the sliding switch.

A face plate 40 is securely mounted in the housing 10 and located above the sliding seat 20. In this embodiment, the face plate 40 includes two engaging pieces 46 provided on each of two lateral sides thereof, and the housing 10 includes two slots 14 defined in each of two lateral sides thereof for receiving the engaging pieces 46. The face plate 40 includes three pairs of slots 41 through which the prongs 42 are extended. As shown in FIG. 2A, the face plate 40 includes a plurality of third recesses 43 each of which is defined in an underside thereof and located adjacent to one of the slots 41. In this embodiment, each recess 43 is defined in the underside of the face plate 40 and the associated slot 41 extends through a bottom face 43*a* defining the third recess 43. Each prong 42 includes an engaging head portion 421 securely received in the associated third recess 43. The face plate 40 further includes at least two V-shape operative grooves 44 defined in the underside thereof. More particularly, each operative groove 44 includes two inclined surfaces 441 and 442 (FIGS. 2A and 5) which meet at a common upper end 443, 444 thereof.

Figure 5:
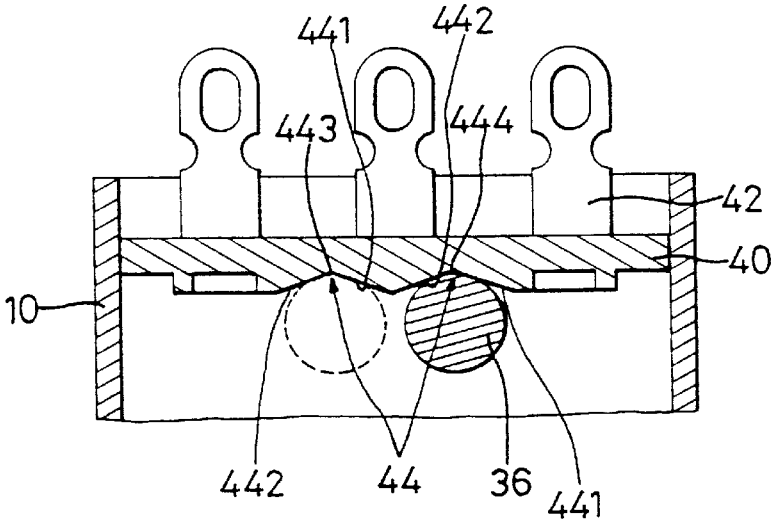
FIG. 5 is a sectional view taken along line 5—5 in FIG. 4.
Figure 6:
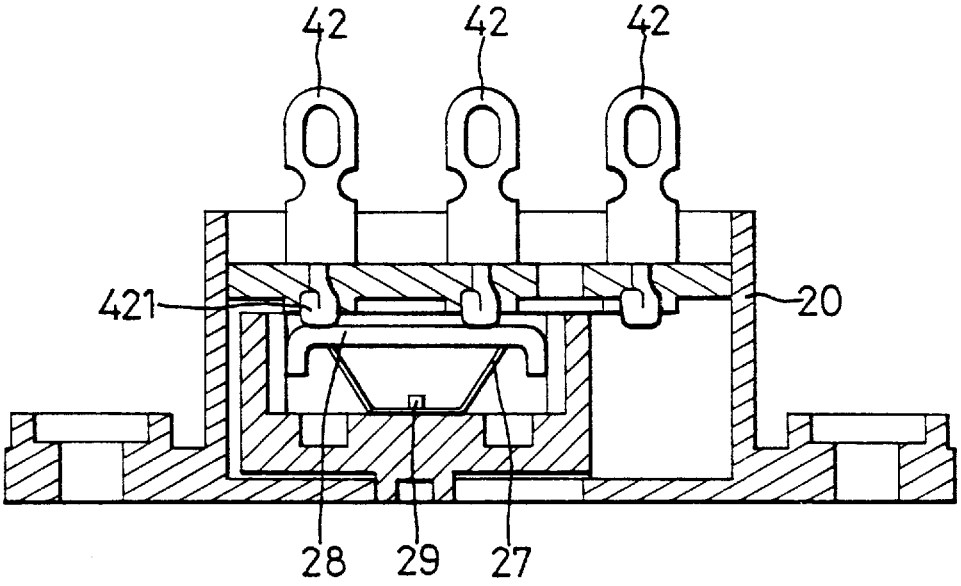
FIG. 6 is a sectional view taken along line 6—6 in FIG. 1.

Referring to FIG. 5, when the wheel 36 is received in the left operative groove 44 (see the phantom lines), the switch is in a first status, e.g., the switch is "OFF" while the conductive plates 28 interconnects the leftmost pair of prongs 42 with the middle pair of prongs 42 (see FIG. 6). When the wheel 36 is received in the right operative groove 44 (see the solid lines), the switch is in a second status, e.g., the switch is "ON" while the conductive plates 28 interconnects the rightmost pair of prongs 42 with the middle pair of prongs 42. Operation of which is conventional and therefore not further described.

Figure 4:
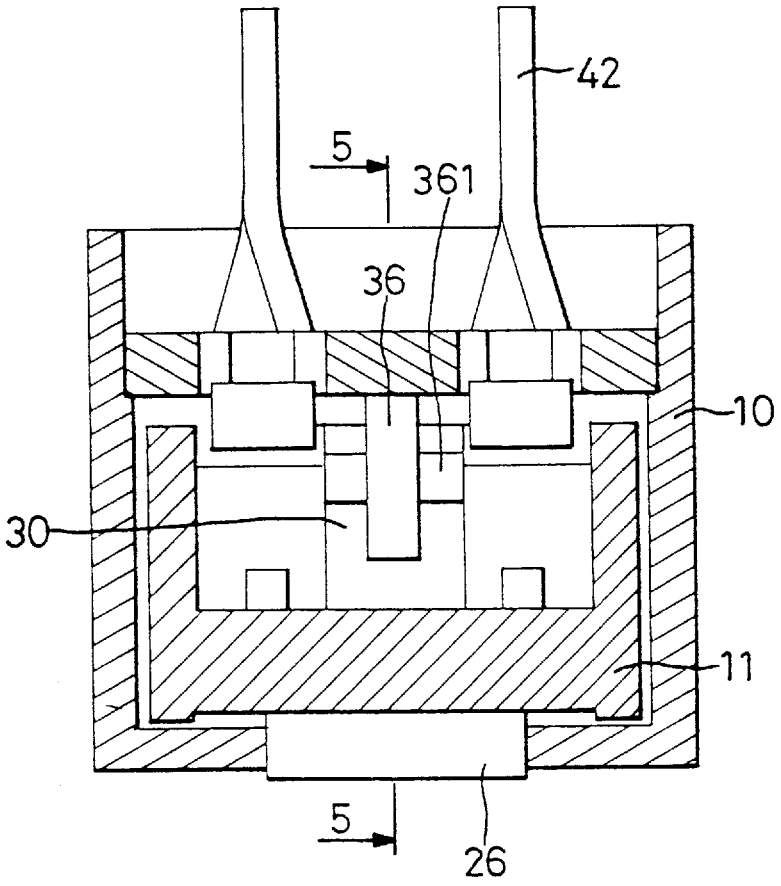
FIG. 4 is a sectional view taken along line 4—4 in FIG. 3.

Referring to FIGS. 3 and 4, the sliding seat 20 is biased by the springs 25 located on both sides of the wheel 36 so as to apply an even force to the fixing means 30 such that the sliding seat 20 may reliably, stably slide in the housing 10 without any swaying motion. Referring to FIGS. 3 and 5, the wheel 36 may reach the common upper end 443, 444 of the operative groove 44 under the action of the springs 25 and thus have a reliable contact with the inclined surfaces 441 and 442 (FIG. 5). In addition, rolling resistance of the wheel 36 is relatively small when compared to the frictional force of the prior art steel ball such that the user may apply a relatively small force to move the sliding seat 20 from one operative groove 44 to the other.

Although the invention has been explained in relation to its preferred embodiment, it is to be understood that many other possible modifications and variations can be made without departing from the spirit and scope of the invention as hereinafter claimed.

What is claimed is:

1. A sliding switch, comprising:

a housing having a compartment defined therein, a sliding seat slidably received in the compartment of the housing and includes a bottom plate, the bottom plate having an operative means mounted to an underside thereof to enable a user to impart sliding motion of the sliding seat in the housing, a fixing means securely mounted in the sliding seat to move therewith, a wheel being rotatably mounted to the fixing means, a face plate securely mounted in the housing and located above the sliding seat, the face plate including a plurality of pairs of slots, and a plurality of pairs of prongs respectively extending through the slots, the face plate further including at least two V-shape operative grooves defined in an underside thereof, the wheel being movable from one of the operative grooves to another of the operative grooves to enable said sliding seat to provide selective electrical connection between said plurality of pairs of prongs, each said operative groove including two inclined surfaces which meet at a common upper end thereof, and means for biasing the fixing means toward the face plate such that the wheel contacts with the two inclined surfaces of the associated operative groove.

2. The sliding switch according to claim 1, wherein the bottom plate of the sliding seat includes two spaced first recesses defined in an upper side thereof, and the fixing means includes two spaced second recesses defined in an underside thereof and respectively in alignment with the first recesses, and the biasing means includes two springs respectively received in the aligned associated said first recess and the associated second recess.

3. The sliding switch according to claim 1, wherein the sliding seat further includes two side walls each of which have a notch defined in an inner side thereof, and the fixing means includes two ends respectively securely received in said notches.

4. The sliding switch according to claim 1, wherein the housing includes a bottom plate which has an opening defined therein, and the operative means on the sliding seat extends through the opening of the housing bottom plate for manual operation.

* * * * *